United States Patent [19]

Wieland, Jr. et al.

[11] 4,150,770

[45] Apr. 24, 1979

[54] ADHESIVE-APPLYING TOOL

[75] Inventors: Howard N. Wieland, Jr., Hanover, Mass.; David H. Hammer, Elyria, Ohio

[73] Assignee: TRW Inc., Cleveland, Ohio

[21] Appl. No.: 744,710

[22] Filed: Nov. 24, 1976

Related U.S. Application Data

[63] Continuation-in-part of Ser. No. 648,494, Jan. 12, 1976, Pat. No. 4,060,180.

[51] Int. Cl.[2] ..... B67D 5/62

[52] U.S. Cl. ..... 222/146 HE; 222/389; 222/394; 219/230; 219/421

[58] Field of Search ..... 222/146 HE, 189, 389, 222/394; 219/230, 421; 277/205; 425/376 R

[56] References Cited

U.S. PATENT DOCUMENTS

| | | | |
|---|---|---|---|
| 3,158,376 | 11/1964 | Rentschler | 277/205 |
| 3,277,276 | 10/1966 | Nichol et al. | 219/421 |
| 3,326,415 | 6/1967 | Estabrooks | 219/421 X |
| 3,743,142 | 7/1973 | Elliot et al. | 222/146 HE |
| 3,951,308 | 4/1976 | Thirtle | 222/146 HE X |

*Primary Examiner*—Robert J. Spar
*Assistant Examiner*—Frederick R. Handren
*Attorney, Agent, or Firm*—James R. O'Connor; Allen D. Gutchess, Jr.

[57] ABSTRACT

A tool is provided for applying adhesive material to a surface. The tool utilizes a cartridge of heat-softenable, thermoplastic material which is positioned in a chamber of the tool. Air under pressure at the rear end of the chamber is applied directly to the rear of the cartridge to urge it toward a heat block located at the forward end of the chamber. That portion of the adhesive material in contact with and near the heat block is softened and flows through passages in the block and past a check valve to a nozzle from which the softened adhesive is directed to the surface. The heat block has a plurality of radially-extending fins which are designed to concentrate heat at the center of the cartridge. The tool features a sleeve of plastic material in the cartridge chamber adjacent the heat block, which sleeve is isolated from the rear portion of the chamber to minimize the conduction of heat toward the rear. The chamber also has three annular, resilient seals therein which separate the air applied to the rear of the cartridge from the forward portion of the chamber with the rear seal also serving as a guide to maintain the adhesive cartridge in proper alignment in the chamber. The chamber has a vent located between the forward two seals through which air passes when the rear end of the cartridge is moved forwardly between these two seals. This serves as a warning to the operator to insert a new cartridge. The new adhesive tool also is equipped with improved heat controls.

9 Claims, 5 Drawing Figures

ADHESIVE-APPLYING TOOL

This application is a continuation-in-part of a copending application of Howard N. Wieland, Jr., Ser. No. 648,494, filed on Jan. 12, 1976, U.S. Pat. No. 4,060,180.

This invention relates to a tool for applying heat-softenable, thermoplastic adhesive material to a surface.

Hot-melt adhesives or glue are finding wider and wider acceptance in commercial and industrial operations. The adhesives can be obtained with a variety of physical characteristics so as to be heat-softenable at wide ranges of temperatures and to harden under various lengths of time. The adhesives are commonly employed in cartridge form and are applied by portable, adhesive-applying tools.

Adhesive cartridges often are somewhat resilient and tend to buckle or expand against the wall of the cartridge chamber of the tool as the cartridges are forced toward a heat block at the forward end of the chamber. The heat from the heat block can also cause portions of the cartridge spaced from the block to become soft or tacky and to tend to adhere to the chamber wall. Further, if a close fit is not achieved between the periphery of the cartridge and the chamber wall, molten adhesive can be forced rearwardly therebetween and re-harden. The resulting binding of the cartridge can stop forward movement thereof and reduce or stop the flow of the molten adhesive material from the chamber.

With adhesive-applying tools heretofore known, the adhesive cartridge would sometimes be consumed in the middle of an operation when the operator was applying a bead of the material. By the time another cartridge was inserted and the tool ready for operation again, the bead previously applied would be hardened. Also with some previous tools, an excessive warm-up time would sometimes be required to ready the adhesive for operation; with other previous tools, when the tools were idle for a while, the cartridges would sometimes tend to become excessively hot and adhere to the cartridge chamber walls.

The new adhesive tool according to the invention has a number of features which result in a number of advantages and overcome the above and other disadvantages in tools heretofore known. In the new tool, air pressure is applied directly to the rear end of the adhesive cartridge and around a rear peripheral portion thereof to substantially eliminate buckling or expansion of the cartridge which results in adherence to the chamber wall. Also, no mechanical drive or moving parts are employed.

The heat block in the new tool has radially-extending fins which are designed so as to concentrate heat at the central portion of the front end of the adhesive cartridge. The heat block also is provided with a transversely-extending passage through which the molten adhesive flows inwardly toward a central discharge passage in the heat block.

The new tool also features a forward sleeve of a plastic material, such as "Torlon" from Amoco, which has low permeability, low friction, low heat conductivity, and high temperature resistance. The sleeve is also physically spaced from wall means forming a rear portion of the cartridge chamber. Consequently, the conduction of heat from the heat block to rear portions of the adhesive cartridge is minimized. Openings are also provided in the tool near the forward sleeve to aid in cooling the sleeve by dissipating heat therefrom.

The cartridge chamber of the new tool also incorporates three spaced, annular, resilient seals therein at intermediate portions of the chamber. These prevent the possibility of air leaking past the cartridge and through the discharge passages in the heat block. The rear seal also acts as a guide or bearing to maintain the cartridge coaxially disposed in the chamber to prevent possible cocking and jamming of the cartridge in the chamber. Between the forward two annular seals there is a vent for discharging a small amount of air from the chamber. As the cartridge is consumed and the rear end moves forwardly past the intermediate seal, air applied to the rear of the cartridge is then expelled through the vent to provide an audible warning to the operator that the cartridge must soon be replaced. However, the operator can finish the bead of adhesive being applied prior to the need for replacement so that the operation is not interrupted and adhesive wasted.

The new adhesive tool can employ two heating elements for the heat block. If the tool is to remain idle for a period of time, one of these elements can be shut off so that excess heating of the cartridge during the idle period will not occur. Alternately, one of the elements can be turned on only when the trigger of the tool is pulled to apply air to the rear of the cartridge to operate the tool. Further, the tool can employ a heat-sensing device or thermostat in the discharge passage of the tool and a second sensing device or thermostat in the chamber itself. In the event that the chamber or cartridge exceeds a predetermined temperature, the thermostat in the chamber can override the one in the discharge passage and shut off the heating element or elements to prevent excess heating of the cartridge and adherence thereof to the chamber wall.

It is, therefore, a principal object of the invention to provide an improved adhesive-applying tool.

Another object of the invention is to provide an adhesive-applying tool having a heat block at a forward end of a cartridge chamber, which block has radially-extending fins designed to concentrate heat at the center of the forward end of an adhesive cartridge in the chamber.

A further object of the invention is to provide an adhesive-applying tool with a cartridge chamber having a forward sleeve of plastic material near a heat block and isolated so as to minimize heat conduction to rear portions of an adhesive cartridge in the chamber.

Still another object of the invention is to provide an adhesive-applying tool with a cartridge chamber having several annular, resilient seals at intermediate portions of the cartridge chamber.

Still a further object of the invention is to provide an adhesive-applying tool having a chamber with at least two annular, resilient seals therein with an air vent therebetween to provide early warning to an operator that the cartridge is about to be expended.

Yet another object of the invention is to provide an adhesive-applying tool having improved heat controls which minimize the chance for excess heating of the adhesive cartridge.

Many other objects and advantages of the invention will be apparent from the following detailed description of preferred embodiments thereof, reference being made to the accompanying drawings, in which.

Figures 1, 2, 3, 4, 5:
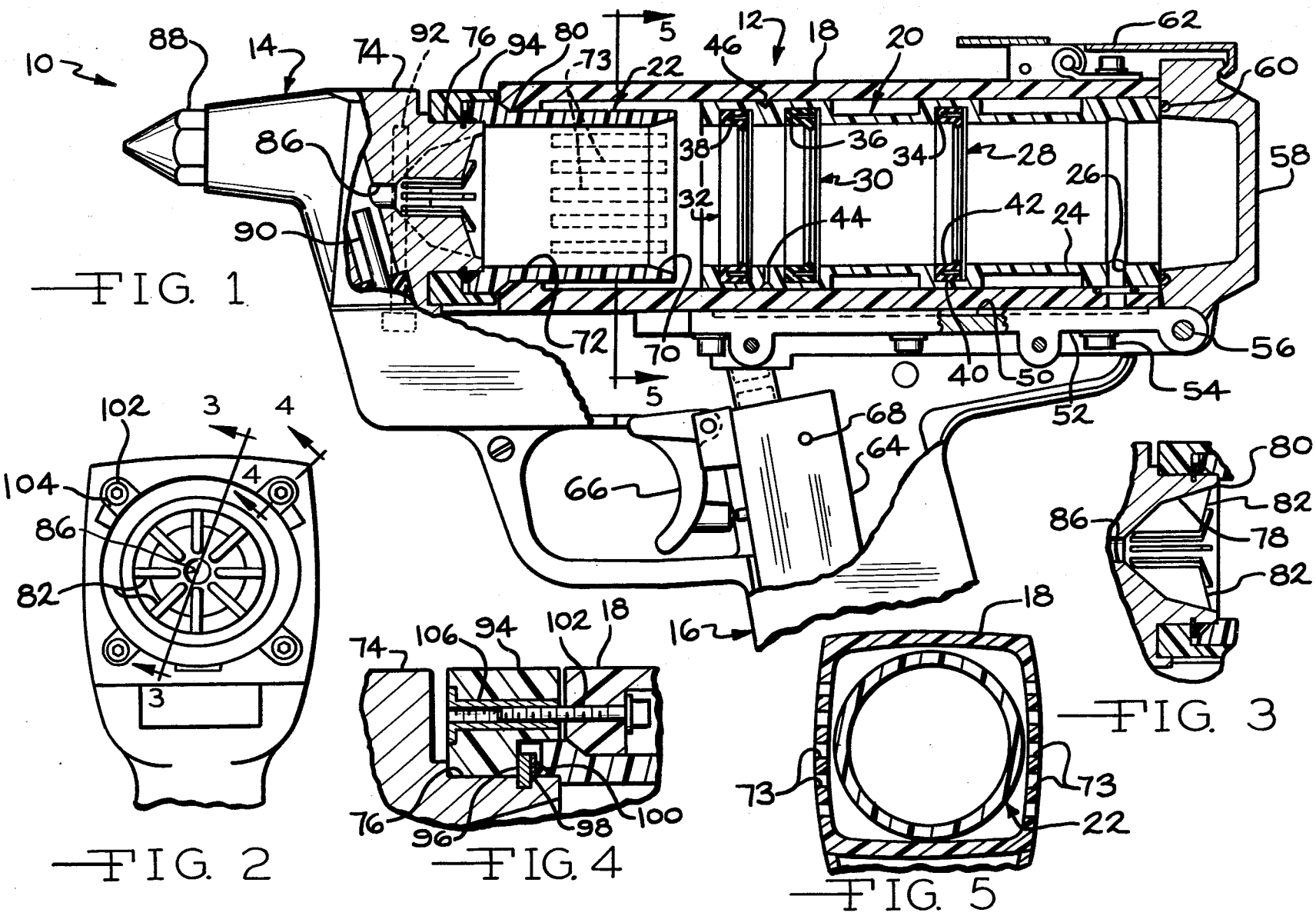
FIG. 1 is a view in elevation, with parts broken away and with parts in cross section, of an adhesive-applying tool according to the invention.
FIG. 2 is a rear view of the tool of FIG. 1 with a rear cover removed.
FIG. 3 is a view in transverse cross section taken along the line 3—3 of FIG. 2.
FIG. 4 is a fragmentary, detailed view in cross section taken along the line 4—4 of FIG. 2.
FIG. 5 is a view in transverse cross section taken along the line 5—5 of FIG. 1.

Referring to the drawings, and particularly to FIG. 1, an adhesive-applying tool according to the invention is indicated at 10. The tool 10 includes three main sections which consist of an adhesive cartridge section 12, a heating and discharge section 14, and a handle section 16.

The cartridge section 12 includes a body 18 of insulating material containing a rear generally cylindrical member or wall means 20 and a forward, cylindrical sleeve or wall means 22 of plastic material. This plastic material has low permeability, low friction, low heat conductivity, and high temperature resistance. The sleeve exhibits a high degree of dimensional stability to maintain a close fit with the periphery of the adhesive cartridge. The cartridges, in turn, are preferably produced by an extrusion process so that their dimensions can be closely held. The member 20 and the sleeve 22 form a cartridge chamber 24 along with the body 18 with the sleeve being isolated or spaced from the member. The chamber 24 has a rear, charge end and a forward, discharge end, with the body 18 and the member 20 forming a supply passage 26 communicating with the charge end of the chamber.

The chamber 24 has three intermediate, annular seals 28, 30 and 32 therein. Specifically, the seals are located in annular grooves 34, 36 and 38 in the cylindrical member 20. Each of the seals is made of a resilient material and, in the form shown, includes an outer annular flange 40 seated in the respective groove and an inwardly-extending resilient flange 42 projecting diagonally into the chamber 24 at an angle toward the charge end thereof. The seals 28, 30 and 32 and specifically the inner flanges 42 thereof engage the periphery of an adhesive cartridge inserted into the chamber 24 from the charge end to prevent air under pressure supplied from the passage 26 from leaking past the cartridge to the discharge end of the chamber 24. This air could possibly force molten adhesive out of the tool in spurts. Air under pressure in the chamber also tends to urge the diagonal flanges 42 inwardly against the cartridge to enhance the sealing properties of the seals.

The rear seal 28 is spaced at some distance from the forward two seals 30 and 32 and provides a bearing or guiding function for the cartridge. Specifically, the seal 28 prevents the adhesive cartridge from moving at an angle or cocking in the chamber and becoming jammed against the wall thereof. Also, with the cartridge held substantially coaxially with respect to the chamber, there is less chance for molten adhesive to be forced rearwardly past one side of the cartridge.

Between the front two seals 30 and 32 is a radially-extending vent opening 44 which communicates with an annular outer groove 46 in the cylindrical member 20. Air from the vent opening 44 is discharged into the groove 46 and is disseminated through clearances around the member 20, the member 20 being cylindrical and the interior of the body 18 being generally rectangular (FIG. 5). When the rear end of an adhesive cartridge in the chamber 24 moves forwardly past the intermediate seal 30, a small portion of the air under pressure in the rear portion of the chamber 24 can escape out the vent 44. This provides the operator with an audible warning that a new cartridge must soon be inserted in the chamber 24 with the rear seal 28 facilitating the loading of the new cartridge. The operator can reload at that time or continue using the tool until the flow of adhesive stops. The tool will continue to function until the rear end of the adhesive cartridge moves past the front seal 32 so that the operator, in most instances, can complete a bead of adhesive which he is laying down with the tool prior to inserting a new cartridge.

Air for the chamber 24 is supplied through the passage 26 from a longitudinally-extending passage 50 formed in a lower metal bar or part 52. The bar 52 is affixed to the body 18 by six bolts 54 and a resilient seal can be located between the bar and the body around the passage 50. A rearward end of the bar 52 extends beyond the end of the body 18 and has a transverse bore receiving a hinge pin 56. The pin hinges a rear cap or cover 58 to the section 12, with a suitable O-ring seal 60 therebetween. An air-tight seal is then maintained at the rear of the chamber 24 when the cover 58 is held closed by an over-center latch 62 of a known design.

Air to the passage 50 is controlled by a valve 64 located in the handle section 16. When the valve is in the position shown with a trigger 66 released, air in the chamber 24 behind the cartridge is vented through the passages 26 and 50 to a vent opening 68 in the valve 64. Thus, when air is shut off and vented, there will not be any pressure remaining in the rear of the chamber 24 which could otherwise continue to urge the cartridge forwardly and possibly cause the adhesive to drip from the tool.

The sleeve 22 at the forward end of the chamber 24 has a tapered entry end 70 which directs the forward end of the cartridge past a cylindrical surface 72. The surface has a close fit with the periphery of the cartridge which is held to close tolerances, with the dimensions of the sleeve 22 also being made and maintained to close tolerances. With the sleeve being made of substantially impermeable plastic material, there is little chance for the cartridge to adhere to the sleeve 22 even if it becomes somewhat tacky to the rear of the heat block section 14. Further, and of particular importance, with the sleeve 22 being physically separated from the rear cylindrical member 20, the two being held in space relationship by the body 18, the chance of heat being conducted back through the chamber walls to the rear portion of the adhesive cartridge is substantially reduced. Toward this goal, the body 18 also has a series of openings or slots 73 (see also FIG. 5) on each side of the sleeve 22 to provide additional heat dissipation particularly by enabling some air circulation in the body around the sleeve. Thus, compressed air for cooling is not required for the new tool as with most previous tools.

The heating and discharge section 14 includes a heat block 74 having a cylindrical rear extension 76. The extension 76 has a rearwardly-facing tapered surface 78 which forms an annular shoulder 80 at the end of the sleeve 22 to help form a seal at the forward end of the cartridge. The tapered surface 78 also helps to shape the cartridge. A plurality of radially-extending fins 82 extend between the surface 78 and the axis of the chamber 24 but stop short so that the inner ends of the fins are spaced apart to form elongate openings therebetween. The fins 82, there being eight in this instance, are designed with a taper, as shown. This, along with the fins being closer together near the center, due to their radial disposition, enables more heat from the block 74 to be transmitted to a central portion of the adhesive cartridge than to the peripheral portions thereof. This is particularly true as the partially-molten adhesive moves down the sides of the fins into the recesses therebetween and through the elongate openings at their inner ends. The possibility that the periphery of the cartridge will become excessively tacky is correspondingly reduced.

When the adhesive is molten, it is discharged inwardly under the pressure of the air through the openings 84 to a central discharge passage 86 in the block 74. From there, the adhesive goes through a check valve (not shown) to a nozzle 88. A temperature sensor or probe 90 indicates the temperature of the adhesive directly as it flows through the discharge passage 86 to provide a temperature reading of the adhesive itself and not that of the heat block. By directly sensing the adhesive temperature, closer control of adhesive viscosity and, consequently, its bonding capability is achieved.

The heating and discharge section 14 is heated to an elevated temperature by two electric resistance elements 92 extending upwardly through the section 14 on each side of the discharge passage 86. These are heated by suitable flexible leads extending downwardly through the tool handle and to a suitable source of power, the power being regulated by an electronic temperature controller which is actuated by a signal from the temperature probe 90. To provide acceptable warm-up time for the tool 10, the heaters must be of reasonably wattage. In such an instance, however, the heaters, over a period of operation, tend to heat the heat block 74 and the chamber 24 sufficiently to cause the cartridge to tend to melt back away from the fins 82. This can cause the cartridge to adhere in the chamber 24 or cause other operational problems. To overcome this, one of the heaters 92 can be of a relatively low wattage and the other of a relatively high wattage. In that instance, after the adhesive tool has initially warmed up for operation, the high wattage heater can be shut off automatically whenever the trigger 66 is released. The adhesive cartridge can then be maintained at an operational temperature without overheating.

If desired, an overriding temperature sensor or thermostat can be used with the chamber 24 to sense the temperature of the adhesive material near the heat block 74. If that temperature becomes excessive, then the heaters 92 can be shut down even though the temperature sensor 90 is calling for heat.

For connecting the heat block 74 to the body 18, a connecting collar or adapter 94 is mounted on the cylindrical extension 76 of the block and held by a snap ring 96, a washer 98, and an O-ring 100 (FIG. 4). The forward end of the sleeve 22 projects into an annular recess formed by the ring 94 and is held by the forward end of the body 18. The body 18, in turn, is connected to the ring 94 by four machine screws 102 in corner recesses 104 (FIGS. 2 and 4) of the body 18. These extend into threaded inserts 106 (FIG. 4) affixed in the connecting collar 94.

Various modifications of the above-described embodiment of the invention will be apparent to those skilled in the art and it is to be understood that such modifications can be made without departing from the scope of the invention, if they are within the spirit and the tenor of the accompanying claims.

We claim:

1. An adhesive-applying tool comprising means forming an adhesive cartridge chamber, said means including rear wall means forming a rear generally cylindrical chamber portion into which a generally cylindrical adhesive cartridge can be inserted, said rear wall means having at least two spaced annular seals engagable with the periphery of the adhesive cartridge, said rear wall means also having vent means between two of said annular seals, said vent means communicating with said cartridge chamber and with space outside said chamber, means for supplying fluid under positive pressure to said rear wall means to the rear of said annular seals, forward wall means forming a forward generally cylindrical chamber portion, means aligning said forward wall means and said rear wall means and spacing said forward wall means from said rear wall means with a gap therebetween, a heat block at the forward end of said forward wall means, said forward wall means being made of a material having a low conductivity, and discharge passage means communicating with said cartridge chamber through said heat block.

2. An adhesive-applying tool according to claim 1 characterized by said forward wall means having an outwardly flared entrance end.

3. An adhesive-applying tool according to claim 1 characterized by said forward wall means being of a plastic material which is substantially impermeable and highly resistant to heat, and said forward wall means being dimensioned to provide a close fit with the periphery of the adhesive cartridge.

4. An adhesive-applying tool according to claim 1 characterized by said heat block having an annular surface flaring outwardly toward said forward wall means.

5. An adhesive-applying tool according to claim 1 characterized by said heat block having a plurality of radially-extending fins facing toward said forward wall means with their inner ends spaced from the axis of said chamber and forming elongate openings therebetween.

6. An adhesive-applying tool according to claim 1 characterized by said aligning and spacing means having openings therein communicating with said forward chamber portion and with air outside the tool.

7. An adhesive-applying tool comprising means forming a cartridge chamber, fluid pressure means at one end of said chamber for applying pressure to an adhesive cartridge in said chamber for urging the cartridge toward the other end of said chamber, heating means at said other end of said chamber, at least two intermediate, spaced, annular seals in said chamber and engagable with the periphery of the adhesive cartridge, vent means between at least two of said annular seals communicating with said chamber for venting fluid pressure therefrom when the rear end of the adhesive cartridge has moved toward said heating means past the second annular seal from said heating means, and an additional resilient, annular seal spaced from the other seals in said chamber on the side of said seals opposite said heating means.

8. An adhesive-applying tool comprising a tool body, wall means within said body forming a cartridge chamber with at least a substantial forward portion of said wall means being spaced inwardly from said tool body, said tool body having a plurality of openings around at least part of said forward portion, with the forward portion of said chamber communicating with said openings in said tool body, fluid pressure means for applying pressure to the rear end of said chamber for urging a cartridge toward a forward end of the chamber, a rear portion of said wall means having a resilient seal for engaging a cartridge within said chamber with said resilient seal being between said fluid pressure means and said forward portion, a heat block at the forward end of said chamber, and means for heating said heat block.

9. An adhesive-applying tool according to claim 8 characterized by the forward portion of said wall means forming the forward portion of said chamber being spaced from a rear portion of said wall means forming the rear portion of said chamber.

* * * * *